US005927888A

United States Patent [19]

Toyama

[11] Patent Number: 5,927,888

[45] Date of Patent: Jul. 27, 1999

[54] CAP FOR WRITING INSTRUMENTS

[75] Inventor: Matsuhei Toyama, Tokyo, Japan

[73] Assignee: Zebra Co., Ltd., Tokyo, Japan

[21] Appl. No.: 08/981,026

[22] PCT Filed: Aug. 1, 1996

[86] PCT No.: PCT/JP96/02165

§ 371 Date: Dec. 24, 1997

§ 102(e) Date: Dec. 24, 1997

[87] PCT Pub. No.: WO97/04968

PCT Pub. Date: Feb. 13, 1997

[30] Foreign Application Priority Data

Aug. 1, 1995 [JP] Japan ..... 7-196444

[51] Int. Cl.[6] ..... B43K 23/08

[52] U.S. Cl. ..... 401/202; 24/11 F; 401/213

[58] Field of Search ..... 401/202, 213, 401/243, 247; 24/11 F, 10 R

[56] References Cited

U.S. PATENT DOCUMENTS

| | | | |
|---|---|---|---|
| 4,979,840 | 12/1990 | Madaus et al. | 401/202 |
| 5,051,015 | 9/1991 | Moeck | 401/202 |
| 5,066,156 | 11/1991 | Petrillo et al. | 401/202 X |
| 5,073,056 | 12/1991 | Belmondo | 401/202 |
| 5,127,754 | 7/1992 | Mase | 401/202 |
| 5,186,564 | 2/1993 | Fuhrmann, III et al. | 401/202 |
| 5,441,356 | 8/1995 | Cho | 401/202 X |

FOREIGN PATENT DOCUMENTS

| | | |
|---|---|---|
| 3-57088 | 5/1991 | Japan . |
| 3-77689 | 8/1991 | Japan . |
| 4-77489 | 7/1992 | Japan . |
| 4104485 | 9/1992 | Japan . |
| 4104486 | 9/1992 | Japan . |
| 7-7199 | 2/1995 | Japan . |

*Primary Examiner*—Henry J. Recla
*Assistant Examiner*—Kathleen J. Prunner
*Attorney, Agent, or Firm*—Greenblum & Bernstein P.L.C.

[57] ABSTRACT

A cap is disclosed for writing instruments such as a mechanical pencil, a ball-point pen, and the like, and particularly a cap for writing instruments to which a safety measure is applied so that even if a curious infant should inadvertently swallow a cap, which as a result becomes lodged in his (or her) throat, passage of air is maintained. The cap includes a closed-end tubular cap body and a body piece fitted in a mounting opening provided with a suitable opening shape at a closed rear end thereof. The body piece is formed to have a shape adapted and matched to an open shape of the mounting opening of the cap body, and a plurality of air ventilating depressions communicate with the interior of the cap body along the edge are provided at the side edge along the open edge of the mounting opening, whereby even if a curious infant should inadvertently swallow a cap, which as a result becomes lodged in his (or her) throat, passage of air is maintained.

3 Claims, 4 Drawing Sheets

CAP FOR WRITING INSTRUMENTS

BACKGROUND OF THE INVENTION

1. Field of the Invention

This invention relates to a cap for writing instruments such as a mechanical pencil, a ball-point pen, and the like, and particularly to a cap for writing instruments to which a safety measure is applied so that even if a curious infant should inadvertently swallow a cap, which as a result becomes lodged in his (or her) throat, ventilation of air is secured.

2. Description of Background Information

The cap for writing instruments to which a safety measure is provided has been hitherto known in the technical field concerned. In general, a cap is designed for the purpose of protecting the writing instrument from a physical damage or for the purpose of improving a design (such as an ornamentation), the cap being detachably mounted on an extreme end (a pen-point) or a rear end of writing instruments. For example, in a case of a cap for a mechanical pencil, a so-called knock-cap, the cap is designed to protect an eraser mounted at a rear end of a tube in which a lead container (a refill) is provided, whereby when an eraser is used or when an eraser is removed and a mechanical lead is placed in the lead container, it can be removed in a simple operation, such as by pulling it off.

Caps for writing instruments to which a safety measure is provided as described above are disclosed, for example, in Japanese utility Model Laid-Open Nos. HEI 4-77489, 4-104485, 4-104486 Publications, and various ventilating constructions have been known.

Any of the conventional caps described above are safety caps which can provide passage of air by the presence of a ventilation construction such as a vent hole provided in the cap itself even if an infant or the like should inadvertently swallow the cap. However, as a result the external (contour) shape is impaired, and the design is adversely affected. For example, in the case of the caps disclosed in Japanese utility Model Laid-Open Nos. HEI 4-104485 and 4-104486 Publications, radially extending ribs are provided which extend outwardly from a tubular portion and toward a rear end of the cap from a centrally located shoulder of the cap and in an axial direction. A vent hole is provided in the end of the tubular member, and the cap has an external shape with a cylindrical body and spherical end shape peculiar to the cap. Accordingly, an object of the present invention is to prevent the degrading of a design or ornamentation for the article while providing a safety measure so that even if a curious infant should inadvertently swallow a cap, which as a result becomes lodged in his (or her) throat, passage of air is maintained.

Further, another object of the invention is to further improve a design of the goods in which a ventilating construction of the safety measure appears to form a pattern.

SUMMARY OF THE INVENTION

The present invention includes a closed-end tubular cap body and a body piece fitted in a mounting opening provided in a suitably shaped opening at a closed rear end thereof. The body piece has a shape sized and matched to the shape of the mounting opening of the cap body, and includes a plurality of parallel, air ventilating depressions communicating into the cap body. The depressions are provided in spaced relation along at least one side edge of the body piece and adjacent an opening edge of said mounting opening.

Accordingly, even if a person should inadvertently swallow a cap, which as a result becomes lodged in his (or her) throat, a plurality of air ventilating depressions communicating with the interior of a cap body are provided in the side edge of the body piece so that passage of air can be maintained. Namely, the ventilation construction to secure passage of air appears as a line pattern by an open edge of a cap body, and by open edges of a plurality of air ventilating depressions of a body piece juxtaposed in a given spaced relation and sized and matched to the edge of the opening.

Furthermore, the present invention includes a bridge piece for supporting a part of a curved projecting end of the body piece which has a narrower width than an opening width of the mounting opening and bridges an internal open part of the curved projecting end of the mounting opening which opens in a substantially U-shape in longitudinal section. Thus, an air ventilating gap that communicates with the interior of the cap body is provided between the bridge piece and an open edge wall surface of the mounting opening.

Accordingly, the body piece provided with the air ventilating depressions that communicates with the cap body is firmly received by a bridge piece of the mounting opening when the body piece is mounted in the mounting opening of the cap body. Thereby, the body piece cannot possibly disengage from the mounting opening when the knock cap is pressed which occurs when the lead is delivered as in a mechanical pencil or in the event the cap body falls onto the floor from the rear end thereof in a manner resulting in a shock to the body piece. Thus, even if an infant or the like should inadvertently swallow a cap, which as a result lodges in his (or her) throat, passage of air is maintained.

Furthermore, in the present invention, the mounting opening is provided to have a substantial U-shape in longitudinal section directed toward both axial peripheral surfaces with a suitable open width from the closed rear end of the cap body, the body piece is formed to have a substantial U-shape in the same sectional shape with an open width of the mounting opening, and a plurality of air ventilating depressions are provided, at symmetrical positions on opposite side edges of a curved projecting end, in a given spaced relation and in parallel along a curved direction widthwise from the edge and along the edge.

Accordingly, the ventilation construction to secure passage of air appears to be in a line pattern formed by an open edge of a curved projecting end of a mounting opening of substantial U-shape in longitudinal section in an axial direction of a cap body, and by open edges of a plurality of air ventilating depressions of a body piece juxtaposed in a given spaced relation in a curved direction adapted and matched to the open edge and along the open edge.

Furthermore, the present invention includes a bridge piece for supporting a part of a curved projecting end of the body piece which has a narrower bridge width than an opening width of the mounting opening and bridges the internal open edge at an open part of the curved projecting end of the mounting opening having a substantially U-shape in longitudinal section. Thus, an air ventilating gap in communication with the interior of the cap body is provided between the bridge piece and an open edge wall surface of the mounting opening.

Accordingly, the body piece provided with the air ventilating depressions communicating with the cap body is firmly received by the bridge piece of the mounting opening when the body piece is mounted in the mounting opening of the cap body. Thereby, the body piece cannot possibly disengage from the mounting opening when the knock cap is pressed which occurs when the lead is delivered as in a mechanical pencil or in the event the cap body falls on the floor from the rear end thereof in a manner resulting in a shock to the body piece. Thus, even if a person should inadvertently swallow a cap, which as a result lodges in his (or her) throat, passage of air is maintained.

DETAILED DESCRIPTION OF THE PREFERRED EMBODIMENTS

Figure 1:
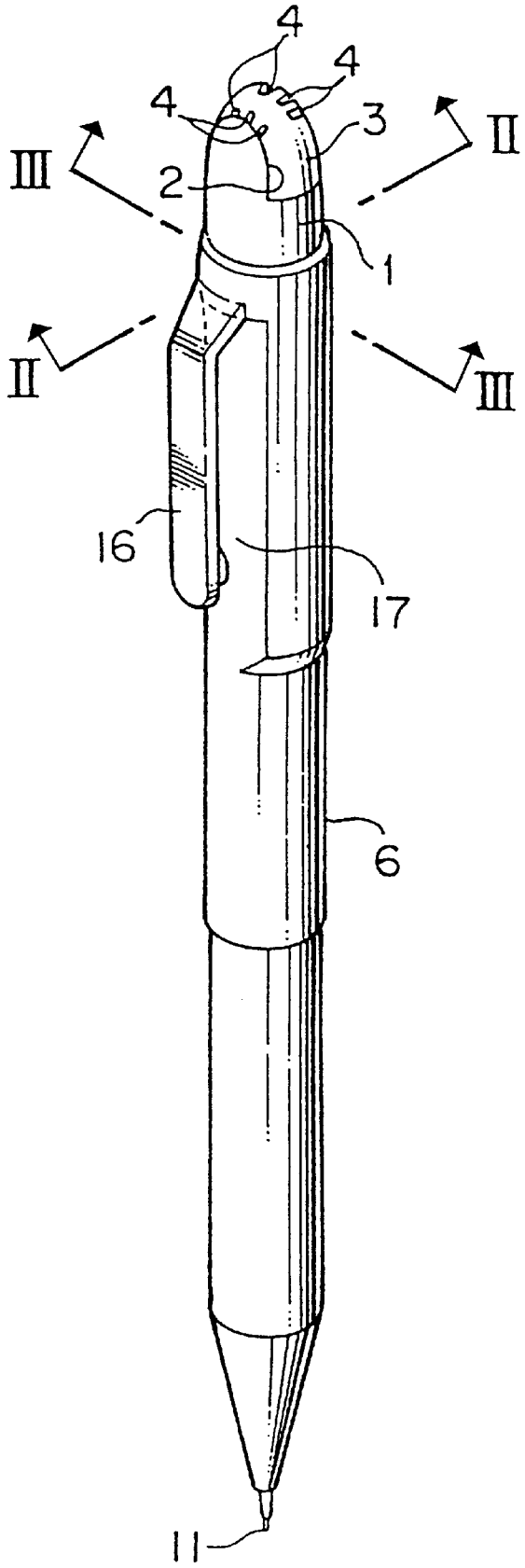
FIG. 1 is a perspective view of a mechanical pencil showing one embodiment of a cap for writing instruments designed so that an eraser of the mechanical pencil is provided.
Figure 2:
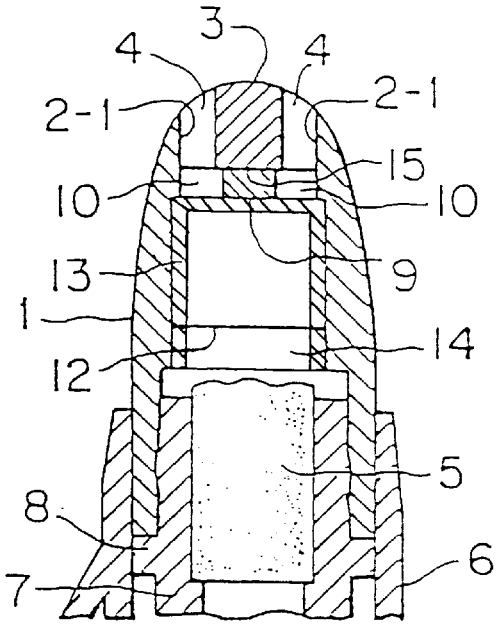
FIG. 2 is an enlarged sectional view taken on line II—II of FIG. 1.
Figure 3:
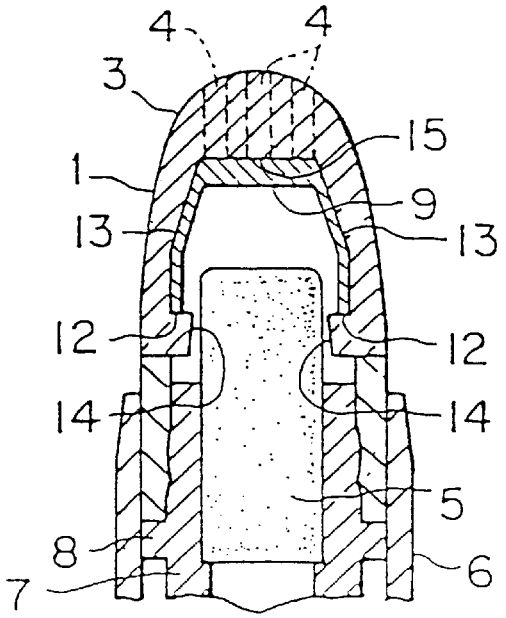
FIG. 3 is an enlarged sectional view taken on line III—III of FIG. 1.
Figure 4:
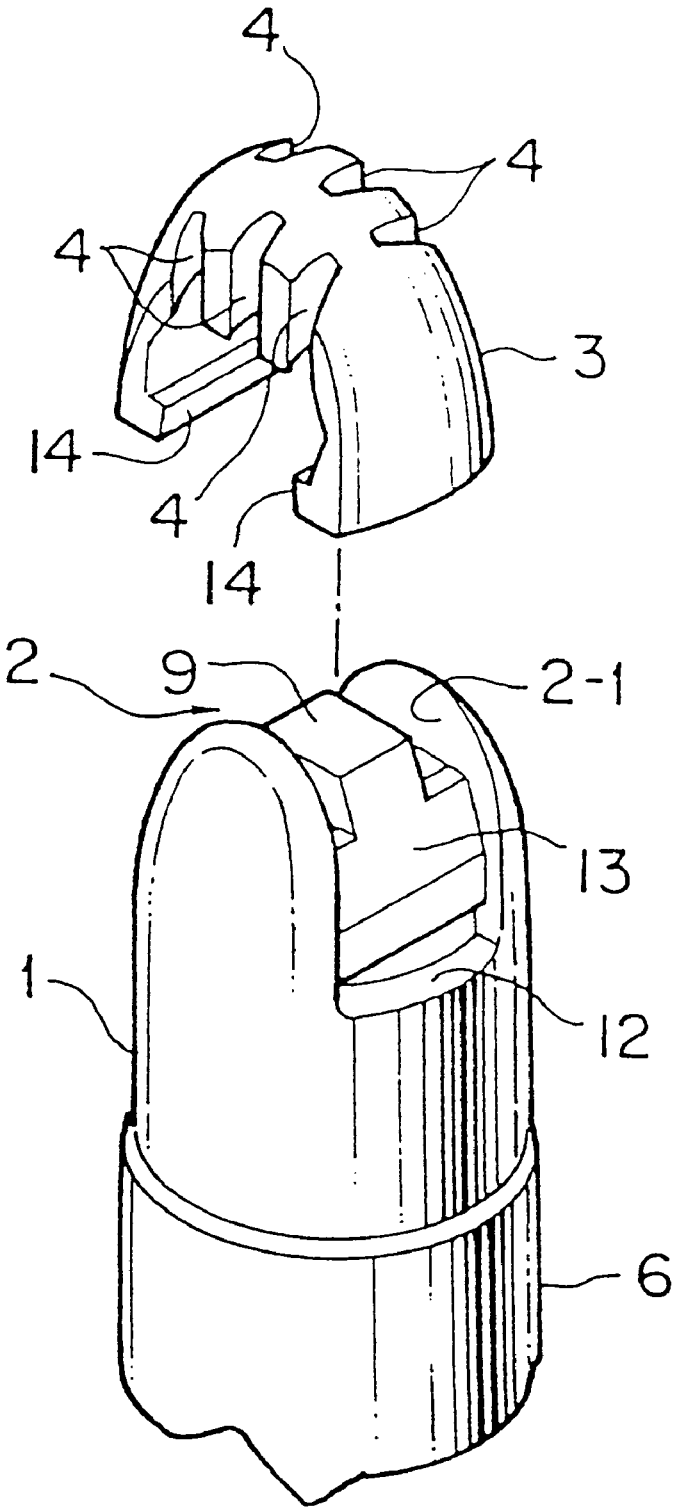
FIG. 4 is an exploded perspective view of the embodiment of FIG. 1 in a condition where a body piece is removed from a cap body.

A first embodiment will be described with reference to the drawings. FIGS. 1 to 4 show an example of a cap designed so that an eraser (5) of a mechanical pencil is provided, a so-called knock cap. A cap body (1) includes an integral molded article molded into a closed end tube of synthetic resin material, and has an inner diameter capable of fitting loosely over the eraser. The cap body (1) has an inner surface formed with a shoulder larger in diameter so as to be detachably fitted in an outer periphery of a rear end opening having an annular rib (8) of a lead container (7) fitted into a shaft tube (6) on a front opening side, and an outer surface having a substantial U-shape in longitudinal section gradually curved from an axial mid-portion toward a rear end terminating in the form of a spherical surface. A mounting opening (2) having a suitable open shape is provided at a closed rear end, and a body piece (3) having a plurality of parallel air ventilating depressions (4) (described later) is fitted in the mounting opening (2), thus providing a safety measure in the event an infant or the like should inadvertently swallow a cap, which has a result becomes lodged in his (or her) throat, passage of air is maintained through the interior of the cap body(1).

The mounting opening (2) is provided to have a substantially U-shape in longitudinal section directed from a closed rear end toward axial peripheral surfaces with a suitable open width. Preferably, the mounting opening (2) is provided in the form of a substantially U-shape in longitudinal section opened toward both peripheral surfaces reaching an axial mid-portion of the cap body (1) and gradually curved toward the rear end. An open width is formed by a pair of open edge wall surfaces (2-1) connected from both open edges in a direction of open width and disposed parallel and opposed to each other in an open state, and with the cap body (1) fitting the eraser (5) in a loosely fitting manner. A bridge piece (9) for supporting a curved projecting end portion of the body piece (3) with a narrower bridge width than the open width of the mounting opening (2) and bridges the internal open edge in an open part (a closed rear end of the cap body (1)) of the open curved projecting end of the mounting opening (2). Thus, an air ventilating gap (10) communicating with the interior of the cap body (1) is provided between the bridge piece (9) and the open edge wall surfaces (2-1) of the mounting opening (2).

The bridge piece (9) has a function such that in a state where the body piece (3) is fitted to the mounting opening (2), when the knock cap is pressed, which occurs when lead (11) is delivered by pressing the rear surface of the curved projecting end of the body piece (3) placed in contact therewith. The body piece (3) is firmly received and supported by a latch opening (12) so that the body piece (3) cannot possibly disengage from the mounting opening (2), such that the body piece (3) is moved into the cap body (1) even where the body piece (3) is pressed toward and into the cap body (1) or where the cap body (1) falls onto the floor or the like from the rear end thereof in a manner resulting in a shock directed at the cap body (1) to the body piece (3). The bridge piece (9) is provided, between both opposed open edge wall surface (2-1) of the mounting opening (2), with a bridge width at which the air ventilating gap (10) for air passage into the air ventilating depressions (4) and the cap body (1) is secured and formed between both open edge wall surfaces (2-1) (see FIG. 2). Thus, bridge piece (9) is positioned over the upper ends of wall portions (13) provided symmetrically internally over both the open edge wall surfaces (2-1) in a bent shape in an axial direction along open edges on both sides of the mounting opening (2) (see FIG. 3). The latch opening (12) is provided by an open width of the mounting opening (2) at the lower part of both wall portions (13) into which a latch pawl (14) (described later) of the body piece (3) is fitted and latched.

The body piece (3) is an integrally molded article molded into a shape sized and matched to the shape of the mounting opening (2) of the cap body (1). The body piece (3) is molded of a synthetic resin material or the like similar to the cap body (1). The piece body (3) may be colored or the like to improve ornamentation of writing instruments including a knock cap. Thus, the rear end of the cap body (1) is provided with a ventilating construction for maintaining passage of air through the interior of the cap body (1), even if the knock cap should be swallowed, resulting in the cap becoming lodged in the throat. The body piece (3) has a substantially U-shape having the same sectional shape along the U-shaped open edge of the mounting opening (2) opened in the form of a substantially U-shape in longitudinal section having the same width as the open width of the mounting opening (2). At the side edge along the open edge of the open curved projecting end of the mounting opening (2) in the curved projecting end part, a plurality of parallel air ventilating depressions (4) are provided in communication with the interior of the cap body (1) along the edge thereof. The latch pawls (14) are fitted and latched with the latch openings (12) of the mounting opening (2) and project internally and in contact with the bridge piece (9). Thus, the cap body (1) is firmly fitted in the mounting opening (2). Further, a contact portion (15) is provided on the body piece (3), and the curved projecting end part thereof is thicker than other parts in a plan and contacts the bridge piece (9).

A plurality of parallel air ventilating depressions (4) are symmetrically provided on opposed side edges at the curved projecting end part of the body piece (3) in fixed spaced relation. The depressions (4) extend in the curved direction along the edge vertically and widthwise so as to close each other from the edge and extend toward the contact portion (15) of the curved projecting end part. Preferably, the air ventilating depressions (4) are provided at a symmetrical position at three locations in an open shape of a substantially U-shape or V-shape in plan with a small open sectional area. That is, air is vented through the cap body (1) by the provision of the ventilation construction in which a flow rate of air necessary and sufficient to avoid possible suffocation is maintained even if a cap is inadvertently swallowed, which results in becoming lodged in a throat. The total open sectional area is provided by the air ventilating depressions (4), which include three on one side, or six on both sides.

Additionally, an outer surface of the shaft tube (6) provided with a clip (16) is formed to have a flat section (17) along peripheral portions about a central width of the clip (16), from the root of clip (16) to the extreme end thereof. Thus, when, for example, a pen is inserted into a note (18) or the like as shown in FIG. 6, a gripping force for holding the note (18) can be increased by the clip (16).

According to the knock cap constructed as described above, even if a curious infant or the like should inadvertently swallow a cap, which results in becoming lodged in his (or her) throat, passage of air can be maintained through the cap body (1) by the presence of the air ventilating depressions (4) which are provided at three locations on both sides at the rear end of the cap body (1), six locations in total, thus providing safety. Since a line pattern formed by the presence of a mutual open edge of the air ventilating depressions (4) provided in parallel in fixed spaced relation in a curved direction at the rear end of the cap body (1) and along an open edge of the curved projecting end of the mounting opening (2) are sized and matched to the open edge, lowering of the aesthetic appearance of the design of the goods does not occur because the external (contour) shape is impaired as in the conventional cap. Conversely, the ventilation construction appears to form a pattern which improves the design. Further, since the cap is formed of two parts, i.e., the cap body (1) having the mounting opening (2) at the rear end and the body piece (3) having a plurality of the air ventilating depressions (4) for securing ventilation of air in parallel, the mold construction can be simplified as compared with the conventional mold for molding a cap. Thereby, the mold can be fabricated in a simple manner and at less cost. Moreover, since the mold construction is simplified, molding is easy, and in addition, a single molding cycle can be shortened.

Further, since the body piece (3) is fitted in the mounting opening (2) such that the body piece (3) is firmly received by the bridge piece (9) and where the latch pawls (14) are fitted and latched in the latch openings (12) of the mounting opening (2), the body piece (3) cannot possibly disengage from the mounting opening (2) when the knock cap is pressed, which occurs when the lead (11) is delivered or in the case where the cap body (1) falls on the floor from the rear end thereof resulting in a shock to the body piece (3).

Figure 5:
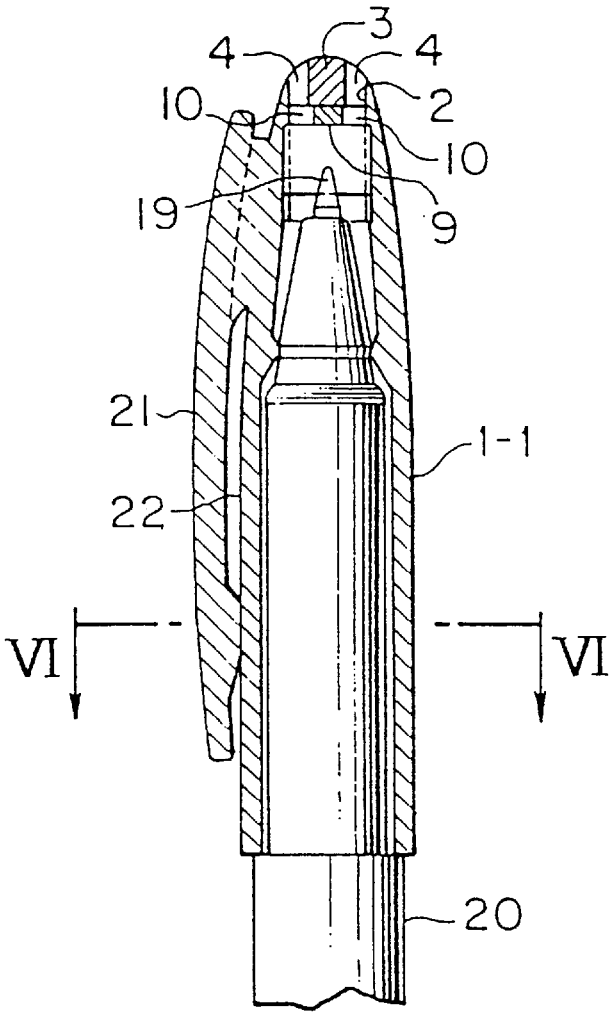
FIG. 5 is a sectional view of main parts showing a second embodiment of a cap for writing instruments according to the present invention designed to fit a pen-point side of a ball-point pen.
Figure 6:
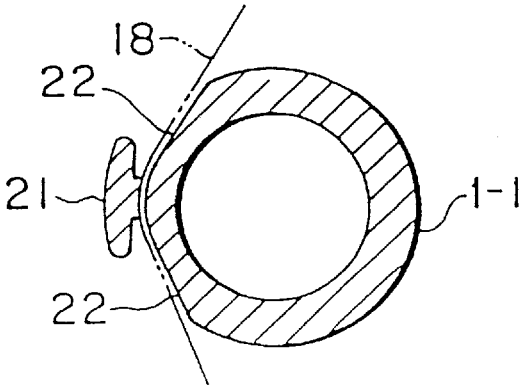
FIG. 6 is an enlarged sectional view taken on line VI—VI of FIG. 5.

FIGS. 5 and 6 show a second embodiment of a cap of the present invention that is designed to cover a tip (19) of a ball-point pen. The mounting opening (2) having a body piece (3) provided with a plurality of parallel air ventilating depressions (4) as described in detail in the previous embodiment is provided at the rear end of a cap body (1—1) to thereby apply a safety measure in which even if the cap is inadvertently swallowed and becomes lodged in a throat, air passage can be maintained through the cap body (1—1).

The second embodiment is basically the same as the construction described in detail in the previous embodiment. Thus, the like parts are indicated by the same reference numerals, and a description of the construction is omitted.

The cap body (1—1) is formed into a closed-end tubular configuration formed of a synthetic resin material having a length and a diameter to cover the extreme end of a shaft tube (20) including the pen tip (19). A clip (21) is provided on the outer surface of the cap body (1—1).

Further, in such an embodiment, as described in detail in the previous embodiment, an outer surface of the cap body (1—1) provided with a clip (21) is formed with a flat section (22) along peripheral portions about a central width of the clip (21) from the root of the clip (16) to the extreme end thereof. Thus, when, for example, a pen is inserted into note (18) or the like (as shown in FIG. 6), a gripping force for holding the note (18) can be increased by the clip (21).

That is, when inserted into the note (18) or the like, the cap body (1—1) is placed in contact with the note (18) or the like with a wide surface contact to prevent a slip-out so as to prevent writing instruments from being easily disengaged.

Accordingly, still another object of the present invention is to provide an improved cap for writing instruments so that the writing instrument is firmly held on the note or the like so as to prevent the writing instrument from being easily disengaged and falling.

As described above, the cap for writing instruments according to the present invention is constructed such that a plurality of air ventilating depressions (4) communicating with the interior of a cap body (1) along the edge are provided in the side edge of a body piece (3) adapted and matched to an open edge of a mounting opening (2) provided in the cap body (1) so that even if an infant or the like should inadvertently swallow a cap, which results in becoming lodged in his (or her) throat, passage of air is maintained.

Further, the ventilation construction to maintain passage of air appears as if in a line pattern by an open edge of a curved projecting end of a mounting opening (2) opened in a substantially U-shape in longitudinal section in an axial direction of a cap body (1), and open edges of a plurality of air ventilating depressions (4) of a body piece are juxtaposed in fixed spaced relation in a curved direction adapted and matched to the open edge and along the open edge.

Further, the body piece provided with the air ventilating depressions (4) communicating with the cap body (1) is firmly received by a bridge piece (9) of the mounting opening (2) in the state where the body piece is mounted on the mounting opening (2) of the cap body (1). Thereby, the body piece cannot possibly engage from the mounting opening (2) when the knock cap is pressed which occurs when the lead is delivered as in a mechanical pencil or in the case where the cap body (1) falls onto the floor from the rear end thereof which results in a shock to the body piece. And even if an infant or the like should inadvertently swallow a cap, which becomes lodged in his (or her) throat, passage of air is maintained.

As the above-mentioned, according to the cap for writing instruments of the present invention, even if a curious infant should erroneously swallow a cap, which as a result is stopped up at his (or her) throat, ventilation of air is secured, and in addition, there is provided a ventilation construction in which a plurality of air ventilating depressed portions (4) are provided in a given spaced relation and in parallel at a tail end of the cap body (1), and therefore, the lowering of design (ornamentation or the like) as the goods is not possibly brought forth as in conventional caps. Moreover, since the ventilation construction applied to the rear end of the cap body (1) appears as if in a pattern, the design can be further improved, and the value as the design can be expected to be enhanced.

The present invention is available as a cap for writing instruments designed to fit a mechanical pencil fitted with an eraser, and as a cap for writing instruments designed so as to fit a pen-point (tip) side of a ball-point pen.

I claim:

1. A cap for writing instruments comprising:

a closed-end tubular cap body and a body piece fitted in a mounting opening of the cap body, the mounting opening being provided with a suitable opening shape at the closed end of the cap body, said body piece having a curved outer profile; said mounting opening having a substantial U-shape in longitudinal section, and forming opposed parallel flat surfaces in the longitudinal direction, with said mounting opening having a suitable open width and directed toward opposite peripheral surfaces in the axial direction from the closed end of the cap body;

said body piece being formed to have a substantially U-shape in longitudinal section and to have substantially the same width and sectional shape as the open width of said mounting opening; and a plurality of parallel air ventilating depressions provided in fixed, spaced relation at symmetrical positions on opposite side edges of said body piece along a part of a curved projecting end.

2. The cap for writing instruments according to claim 1, wherein a bridge piece is provided internally of an open edge at an open part of a curved projected end of the mounting opening having a substantially U-shape in longitudinal section, said bridge piece supporting a part of said curved projecting end of said body piece with a narrower bridge width than the open width of the mounting opening, and an air ventilating gap in communication with the interior of the cap body is provided between said bridge piece and the opposed parallel flat surfaces of the mounting opening.

3. The cap for writing instruments according to claim 2, wherein wall portions are provided on the cap body along the open edge in the axial direction of the mounting opening and symmetrically between both the opposed flat surfaces;

said bridge piece is provided over upper ends of said wall portions; and a latch opening is provided at the lower part of each said wall portions, said latch opening having an open width substantially equal to the mounting opening, and a latch pawl is provided on each end portion of said body piece to fit and latch with said latch opening.

* * * * *

UNITED STATES PATENT AND TRADEMARK OFFICE

CERTIFICATE OF CORRECTION

PATENT NO. : 5,927,888

DATED : July 27, 1999

INVENTOR(S) : M. TOYAMA

It is certified that error appears in the above-identified patent and that said Letters Patent is hereby corrected as shown below:

column 8, line 3 (claim 2, line 3) of the printed patent, "projected" should be —projecting—.

Signed and Sealed this

Twenty-first Day of November, 2000

*Attest:*

Q. TODD DICKINSON

*Attesting Officer*

*Director of Patents and Trademarks*